US012024890B2

(12) United States Patent
Burkes et al.

(10) Patent No.: US 12,024,890 B2
(45) Date of Patent: Jul. 2, 2024

(54) TUBULAR SKYLIGHT ASSEMBLY

(71) Applicant: VKR HOLDING A/S, Horshølm (DK)

(72) Inventors: Brian Jefferson Burkes, Greenwood, SC (US); Brantlee Burnett Nickles, Waterloo, SC (US)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 17/950,550

(22) Filed: Sep. 22, 2022

(65) Prior Publication Data

US 2023/0085785 A1 Mar. 23, 2023

Related U.S. Application Data

(60) Provisional application No. 63/246,954, filed on Sep. 22, 2021.

(51) Int. Cl.
*E04D 13/035* (2006.01)
*E04D 13/03* (2006.01)

(52) U.S. Cl.
CPC ..... *E04D 13/0351* (2013.01); *E04D 13/0335* (2013.01); *E04D 2013/034* (2013.01)

(58) Field of Classification Search
CPC ..... E04D 13/0315; E04D 13/0335; E04D 13/0351; E04D 2013/034
See application file for complete search history.

(56) References Cited

U.S. PATENT DOCUMENTS 1,935,583 A * 11/1933 Thurn ..... C03B 13/12 428/433
3,065,572 A * 11/1962 Weingartner ..... E04D 13/1407 52/96
3,307,303 A * 3/1967 Bloxsom ..... E04D 13/03 220/88.1
3,434,250 A * 3/1969 Kiekhaefer ..... E04D 13/0315 52/22
3,473,276 A * 10/1969 Back ..... E04D 13/03 52/200
4,339,900 A * 7/1982 Freeman ..... E04D 13/03 52/22
4,978,405 A * 12/1990 Hickman ..... B32B 17/10412 264/261
5,219,630 A * 6/1993 Hickman ..... B32B 17/10761 156/107

(Continued)

FOREIGN PATENT DOCUMENTS

CA 2632494 A1 * 1/2006 ..... E04D 13/031
CN 106642008 A * 5/2017

(Continued)

*Primary Examiner* — James M Ference
(74) *Attorney, Agent, or Firm* — Amy E. Allen Hinson; Parker Poe Adams & Bernstein LLP

(57) ABSTRACT

A tubular skylight assembly. The tubular skylight assembly may include a light tube pitch adapter that may be adjustable to alter an angle between its ends, a cylindrical light tube secured to the light tube pitch adaptor, a collar for securing to the light tube pitch adapter, a flashing surround preferably having an exterior base and a top cover, and a skylight cover having an outer frame and a glass pane. The collar and light tube pitch adapter may reside at least partially within the exterior base of the flashing surround and the skylight cover may be disposed over the top cover of the flashing surround.

14 Claims, 2 Drawing Sheets

(56) References Cited

U.S. PATENT DOCUMENTS 5,322,660 A * 6/1994 Hickman ..... B32B 17/10917 264/261
5,502,935 A * 4/1996 Demmer ..... E04B 9/32 52/22
5,546,712 A * 8/1996 Bixby ..... F21S 11/00 52/220.8
5,878,539 A * 3/1999 Grubb ..... E04D 13/03 52/200
6,035,593 A * 3/2000 Chao ..... E04B 9/32 52/200
6,052,956 A * 4/2000 Hoy ..... E04D 13/031 52/200
6,219,977 B1 * 4/2001 Chao ..... E04D 13/03 52/200
6,256,947 B1 * 7/2001 Grubb ..... F21S 11/00 52/28
6,263,624 B1 * 7/2001 Hoy ..... E04D 13/1475 52/200
6,918,216 B2 * 7/2005 Hoy ..... E04D 13/03 52/220.8
7,168,211 B2 * 1/2007 Prenn ..... E04D 13/03 285/43
7,322,156 B1 * 1/2008 Rillie ..... E04D 13/033 52/200
7,380,377 B2 * 6/2008 Brinton ..... E04D 13/031 52/60
7,624,547 B1 * 12/2009 Brinton ..... E04D 13/0315 52/60
7,757,444 B1 * 7/2010 Halliday ..... E04D 13/03 52/173.3
8,292,706 B2 * 10/2012 Moller ..... F21V 33/0088 454/339
8,479,461 B2 * 7/2013 Lanham ..... H05B 47/165 52/173.3
8,555,571 B2 * 10/2013 Darmer ..... E04D 13/03 52/200
8,736,961 B2 * 5/2014 Lydecker ..... F21S 11/00 52/200
8,833,010 B1 * 9/2014 Schlabach ..... E04D 13/0305 52/200
8,896,924 B2 * 11/2014 Weaver ..... G02B 19/0028 52/200
9,453,343 B1 * 9/2016 Brinton ..... E04D 13/0315
2003/0000158 A1 * 1/2003 Borges ..... E04D 13/03 52/200
2003/0061775 A1 * 4/2003 Rillie ..... E04D 13/033 52/200
2003/0066254 A1 * 4/2003 DeBlock ..... E04D 13/1476 52/200
2005/0039410 A1 * 2/2005 Hoy ..... E04D 13/03 52/200
2005/0044807 A1 * 3/2005 Rillie ..... E04D 13/1476 52/200
2005/0044808 A1 * 3/2005 Prenn ..... E04D 13/03 52/200
2005/0166490 A1 * 8/2005 Darmer ..... E04D 13/03 52/200
2006/0150542 A1 * 7/2006 Brinton ..... E04D 13/031 52/200
2007/0068096 A1 * 3/2007 O'Hagin ..... E04D 13/03 52/200
2007/0074468 A1 * 4/2007 Jaster ..... F21V 5/02 52/200
2007/0180789 A1 * 8/2007 Valentz ..... E04D 13/03 52/200
2007/0266652 A1 * 11/2007 Jaster ..... E04D 13/03 52/200
2008/0104903 A1 * 5/2008 Jaster ..... E04D 13/033 52/200
2008/0302032 A1 * 12/2008 Valentz ..... E04D 13/03 52/200
2009/0031649 A1 * 2/2009 Nemazi ..... E04D 13/0315 52/745.15
2010/0011682 A1 * 1/2010 Lundsgaard ..... E04D 13/031 52/745.15
2010/0011683 A1 * 1/2010 Lundsgaard ..... E04D 13/031 52/745.15
2010/0018138 A1 * 1/2010 Lundsgaard ..... E05F 15/619 52/200
2010/0325979 A1 * 12/2010 Jaster ..... E04D 13/033 52/200
2011/0162304 A1 * 7/2011 Jaster ..... F21V 7/28 52/200
2011/0289870 A1 * 12/2011 Nemazi ..... E04C 1/42 52/200
2012/0174506 A1 * 7/2012 Buckley ..... F21S 19/005 52/745.15
2012/0255246 A1 * 10/2012 Jaster ..... E04D 13/033 52/200
2013/0086853 A1 * 4/2013 Brandalik ..... E04D 13/03 52/200
2013/0314795 A1 * 11/2013 Weaver ..... G02B 19/0028 359/591
2014/0026501 A1 * 1/2014 Schuetz ..... E04D 13/033 52/200
2015/0128516 A1 * 5/2015 Valencia ..... E04D 13/0315 52/302.6
2016/0153194 A1 * 6/2016 Kristensen ..... E04D 13/033 52/200
2017/0009947 A1 * 1/2017 Jaster ..... E04D 13/032
2019/0203474 A1 * 7/2019 Burkes ..... G02B 19/0038
2019/0203475 A1 * 7/2019 Burkes ..... G02B 27/0955
2023/0082828 A1 * 3/2023 Rillie ..... E04D 13/0315 52/200
2023/0085785 A1 * 3/2023 Burkes ..... E04D 13/0315 52/200

FOREIGN PATENT DOCUMENTS

EP 3779088 A1 * 2/2021 ..... E04D 13/0315
GB 2355471 A * 4/2001 ..... E04D 13/02
JP 2006054071 A * 2/2006
WO WO-2010151369 A1 * 12/2010 ..... E04D 13/033
WO WO-2011150900 A2 * 12/2011 ..... E04D 13/03
WO WO-2012161765 A1 * 11/2012 ..... E04D 13/0315

* cited by examiner

TUBULAR SKYLIGHT ASSEMBLY

CROSS-REFERENCE TO RELATED APPLICATIONS

This application claims the benefit of U.S. Provisional Patent Application No. 63/246,954 filed on Sep. 22, 2021. The disclosure of the foregoing patent application is expressly incorporated herein by reference in its entirety.

BACKGROUND OF THE INVENTION

This disclosure relates to a tubular skylight assembly. More particularly, this disclosure relates to an assembly having tubular components that transfer natural light into a structure. By use of the assembly of the present invention, natural light may be economically and energy efficiently transferred into a structure while also providing a heat tolerant and fire resistant assembly.

These and other features and advantages will be apparent from a careful review of the Detailed Description of the Invention below, accompanied by the drawings.

BRIEF SUMMARY OF THE INVENTION

A new tubular skylight assembly has been discovered that provides for great adaptability and energy efficiency as well as provides increased heat tolerance.

In accordance with certain aspects of certain embodiments of the present technology, the tubular skylight assembly may include a light tube pitch adapter having a first end and an opposing second end, wherein the pitch adapter may be adjustable to alter an angle between the first end and the opposing second end. Further, the tubular skylight assembly may include a cylindrical light tube having a first end and an opposing second end, wherein the opposing second end of the light tube pitch adapter may be secured to the first end of the cylindrical light tube. Additionally, the tubular skylight assembly may include a collar for securing to the first end of the light tube pitch adapter and a flashing surround preferably having an exterior base and a top cover, wherein the top cover of the flashing surround may have a circular opening that corresponds in shape and dimension to the collar and the first end of the light tube pitch adapter. Moreover, the collar and light tube pitch adapter may reside at least partially within the exterior base of the flashing surround. The tubular skylight assembly may also include a skylight cover having an outer frame and a glass pane, wherein the skylight cover may be disposed over the top cover of the flashing surround.

In a further embodiment of the present invention, the tubular skylight assembly may include a light tube pitch adapter having a first end, an opposing second end, and seams that preferably alter an angle between the first end and the opposing second end. Further, the tubular skylight assembly may include a cylindrical light tube having a first end and an opposing second end, a collar having an upper cylindrical rim and a cylindrical base, and a flashing surround having an exterior base and a top cover. The top cover of the flashing surround may include a circular opening that corresponds in shape and dimension to the first end of the light tube pitch adapter. Further, the tubular skylight assembly may include a skylight cover having an outer frame and a glass pane, wherein the skylight cover may be disposed over the top cover of the flashing surround. The opposing second end of the light tube pitch adapter may be secured to the first end of the cylindrical light tube, the cylindrical base of the collar may be disposed within the first end of the light tube pitch adapter, the upper cylindrical rim of the collar may be disposed on the top cover of the flashing surround, and the cylindrical base of the collar and at least a portion of the light tube pitch adaptor may reside within the exterior base of the flashing surround.

The present invention further includes a method for installing a tubular skylight assembly. The method may include the step of providing a light tube pitch adapter having a first end, an opposing second end, and seams to alter an angle between the first end and the opposing second end. The method may further include the steps of providing a cylindrical light tube having a first end and an opposing second end, providing a collar having an upper cylindrical rim and a cylindrical base, and providing a flashing surround having an exterior base and a top cover, wherein the top cover of the flashing surround may include a circular opening that corresponds in shape and dimension to the first end of the light tube pitch adapter. Additionally, the method may include the step of providing a skylight cover having an outer frame and a glass pane, wherein the skylight cover may be disposed over the top cover of the flashing surround. Furthermore, the method may include the steps of securing the flashing surround to a roof structure so that the exterior base may be disposed on the roof structure, securing the opposing second end of the light tube pitch adapter to the first end of the cylindrical light tube, inserting the cylindrical base of the collar into the first end of the light tube pitch adapter, and inserting the combined collar, light tube pitch adapter, and cylindrical light tube through the circular opening of the flashing surround so that the upper cylindrical rim may be disposed above the top cover of the flashing surround and the cylindrical base of the collar and at least a portion of the light tube pitch adaptor may reside within the exterior base of the flashing surround. The method may also include the step of securing the skylight cover above the collar and top cover of the flashing surround.

These and other features and their advantages will be apparent from a careful review of the detailed description below, accompanied by the following drawings.

BRIEF DESCRIPTION OF THE SEVERAL VIEWS OF THE DRAWING

The aspects described above, as well as other apparent aspects, advantages, and objectives of the present invention are apparent from the detailed description below in combination with the drawings, in which.

DETAILED DESCRIPTION OF THE INVENTION

The present invention may be understood more readily by reference to the following detailed description, examples, drawings, and claims, and their previous and following descriptions. However, it is to be understood that this invention is not limited to the specific devices, systems, and/or component disclosed unless otherwise specified, as such can vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to "a light tube pitch adaptor" can include two or more such adaptors unless the context requires otherwise.

The accompanying figures illustrate certain of the foregoing aspects of a tubular skylight assembly, as well as additional aspects thereof. The figures represent embodiments of the invention and are not intended to limit the invention.

Figure 1:
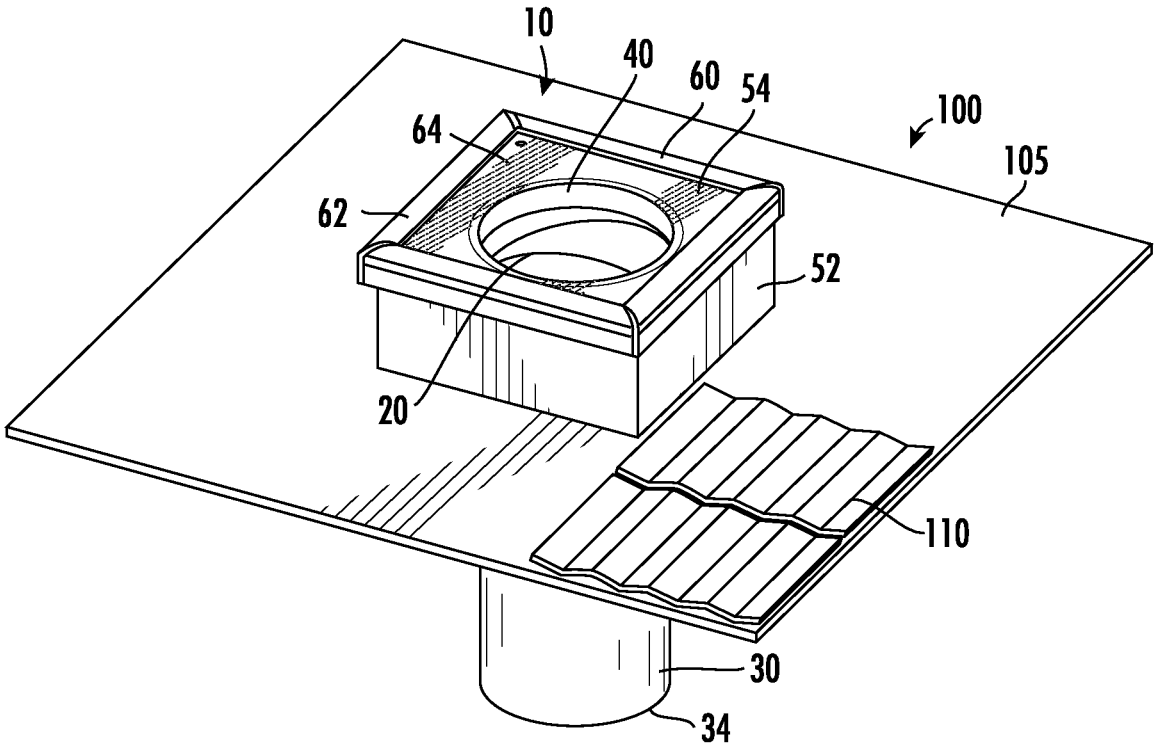
FIG. 1 is a perspective view of a tubular skylight assembly secured to a roof type structure in accordance with an embodiment of the present invention.

As illustrated in FIG. 1, a tubular skylight assembly 10 is provided. The tubular skylight assembly 10 may be secured to a roof structure 100, which preferably includes a sub layer 105, such as a plywood sub layer, that supports the roof structure 100. Further, the roof structure 100 preferably includes a top layer 110, such as roof tiles or shingles, that is exposed to the natural environmental elements. The top layer 110 preferably entirely surrounds the tubular skylight assembly 10 on the roof structure 100.

Figure 2:
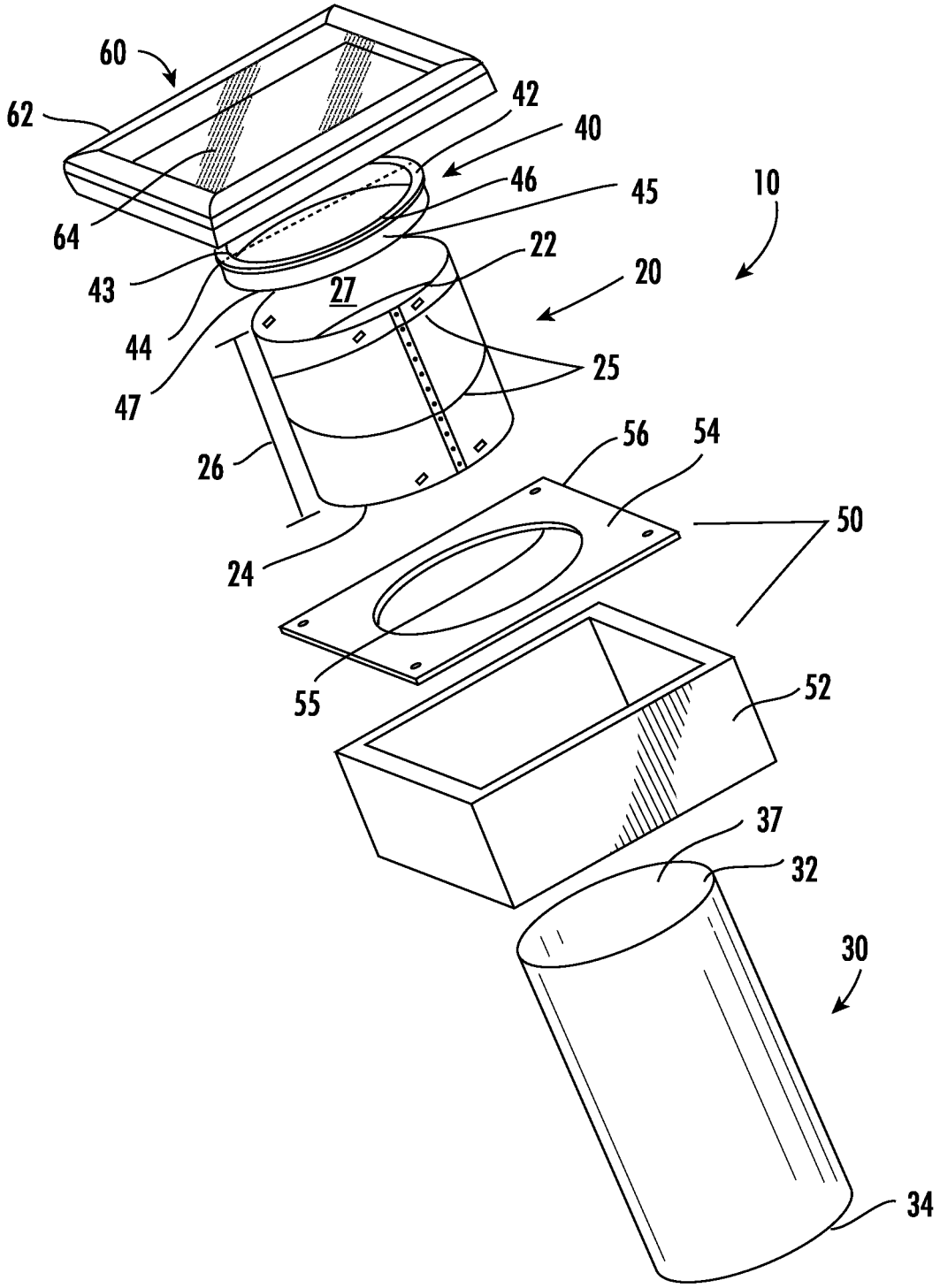
FIG. 2 is an exploded perspective view of a tubular skylight assembly in accordance with an embodiment of the present invention.

FIG. 2 sets forth an exploded view of an embodiment of a tubular skylight assembly 10 of the present invention. As illustrated in FIG. 2, the tubular skylight assembly 10 may include a light tube pitch adapter 20. In one embodiment, the light tube pitch adapter includes a first end 22 and an opposing second end 24. Preferably, the pitch adapter 20 is adjustable to alter the angle between the first end 22 and opposing second end 24. The light tube pitch adapter may further include one or more adjuster seams 25 that allow for modifying the angle between the first end 22 and the opposing second end 24. Further, the seams 25 may allow the length 26 of the light tube pitch adapter 20 to increase. In one embodiment, the angle between the first end 22 and opposing second end 24 may be between about 135-180 degrees (exploded FIG. 2 illustrates the light tube pitch adaptor 20 having a 180 degree angle between the first end 22 and the opposing second end 24). Alternatively, the angle between the first end 22 and opposing second end 24 may be between about 90-180 degrees. Further alternatively, the angle between the first end 22 and opposing second end 24 may be between about 45-180 degrees. In yet another embodiment, the angle between the first end 22 and the opposing second end 24 may be up to 180 degrees. In some embodiments, the light tube pitch adaptor allows for multiple angles across its length. The internal surface 27 of the light tube pitch adaptor 20 is preferably reflective to allow for light travel through the adaptor 20.

The tubular skylight assembly 10 may further include a cylindrical light tube 30. In one embodiment, the cylindrical light tube 30 has a first end 32 and an opposing second end 34. Preferably, the opposing second end 24 of the light tube pitch adapter 20 is secured to the first end 32 of the cylindrical light tube 30. In one embodiment, the cylindrical light tube 30 is rigid. In an alternative embodiment, the cylindrical light tube 30 is flexible. In yet a further alternative embodiment, the cylindrical light tube 30 includes a flexible light tube segment and a rigid light tube segment. The internal surface 37 of the cylindrical light tube 30 is preferably reflective to allow for light travel through the tube 30.

Additionally, the tubular skylight assembly 10 may include a collar 40 for securing to the first end 22 of the light tube pitch adapter 20. In one embodiment of the present invention, the collar 40 may be cylindrical. Further, the collar 40 may include an upper cylindrical rim 42 having an inner diameter 43 and an outer diameter 44. The collar 40 may further include a cylindrical base 45 having an inner diameter 46 that is the same as the inner diameter 43 of the cylindrical rim 42 and an outer diameter 47 that is less than the outer diameter 44 of the cylindrical rim 42.

The tubular skylight assembly 10 may include a flashing surround 50. In one embodiment, the flashing surround 50 includes an exterior base 52 and a top cover 54. Preferably, the top cover 54 of the flashing surround includes a circular opening 55 that corresponds in shape and dimension to the collar 40 and the first end 22 of the light tube pitch adapter 20. In an embodiment of the present invention, the collar 40 and light tube pitch adapter 20 may reside at least partially within the exterior base 52 of the flashing surround 50. In one embodiment of the present invention, the exterior base 52 of the flashing surround 50 forms a rectangular shape. Further, the outer perimeter 56 of the top cover 54 forms a rectangular shape that corresponds to the rectangular shape of the exterior base 52 of the flashing surround 50. In one embodiment such as illustrated in FIG. 2, the exterior base 52 and top cover 54 are separate components that may be secured together. In an alternative embodiment, the exterior base 52 and top cover 54 are integral components.

The tubular skylight assembly 10 may further include a skylight cover 60. In one embodiment, the skylight cover 60 includes an outer frame 62 and a glass pane cover 64. Preferably the skylight cover 60 is disposed over the top cover 54 of the flashing surround 50. In one embodiment of the present invention, the glass pane cover 64 may be secured within the outer frame 62 of the skylight cover 60. In one embodiment, the skylight cover 60 forms a rectangular shape. Further, in an embodiment of the present invention, the outer frame 62 and/or the glass pane cover 64 form a rectangular shape.

The glass pane 64 may be a single pane of glass. Alternatively, the glass pane 64 may be multiple panes of glass. For example, the glass pane 64 may be double panes of glass. In one embodiment, the glass pane 64 includes a tempered glass pane and an embedded diamond wire glass pane.

The tubular skylight assembly may be secured to a fixture within a structure to provide natural energy efficient light within the structure. The fixture may be any number of known lighting fixtures. In an embodiment of the present invention, the lighting fixture may include a diffuser. In another embodiment of the present invention, the lighting fixture may include an alternate light source to provide supplemental light, such as when the sun is not shining and at night. In yet another embodiment, the lighting fixture may include a shade to block the natural light when a user seeks a dark room.

The tubular skylight assembly of the present invention may include multiple light tube pitch adapters 20 and/or multiple cylindrical light tubes 30. The number of light tube pitch adapters 20 and/or cylindrical light tubes often depends on the distance needed from the skylight cover 60 to a desired location for a lighting fixture. Moreover, the number of light tube pitch adapters 20 and/or cylindrical light tubes often depends on the angles needed to connect such components within a structure.

Configuration of the tubular skylight assembly of the present invention as well as the components thereof may be of any size, shape, or geometry that allows for the collecting and distributing of natural light to the inside of a structure. The spacing and orientation of the components of the tubular skylight assembly design preferably maximizes natural light transfer while also limiting the number of necessary components. Further, the design may allow for variations depending on the space within a structure for installing such an assembly, which is preferably minimized.

Unless otherwise stated, the various components of the enclosure system of the present invention may be composed of any number of materials. For example, the components may be composed of metal, non-metal, such as plastic, wood, glass, or combinations of such materials. Further, the components of the present invention may be secured together using any number of known securing means, such as clips, screws, adhesives, etc. The tubular skylight assembly may be customized depending on the size, angles, and space needed for the particular assembly.

In one particularly preferred embodiment of the present invention, the tubular skylight assembly includes a light tube pitch adapter having a first end and an opposing second end, wherein the pitch adapter may be adjustable to alter an angle between the first end and the opposing second end. Further, the tubular skylight assembly of this embodiment may include a cylindrical light tube having a first end and an opposing second end, wherein the opposing second end of the light tube pitch adapter may be secured to the first end of the cylindrical light tube. Additionally, the tubular skylight assembly of this embodiment may include a collar for securing to the first end of the light tube pitch adapter and a flashing surround having an exterior base and a top cover, wherein the top cover of the flashing surround may have a circular opening that corresponds in shape and dimension to the collar and the first end of the light tube pitch adapter. Moreover, the collar and light tube pitch adapter may reside at least partially within the exterior base of the flashing surround. The tubular skylight assembly of this embodiment may also include a skylight cover having an outer frame and a glass pane, wherein the skylight cover may be disposed over the top cover of the flashing surround.

In another particularly preferred embodiment of the present invention, the tubular skylight assembly includes a light tube pitch adapter having a first end, an opposing second end, and seams to alter an angle between the first end and the opposing second end. Further, the tubular skylight assembly of this embodiment may include a cylindrical light tube having a first end and an opposing second end, a collar having an upper cylindrical rim and a cylindrical base, and a flashing surround having an exterior base and a top cover. In this embodiment, the top cover of the flashing surround may include a circular opening that corresponds in shape and dimension to the first end of the light tube pitch adapter. The tubular skylight assembly of this embodiment may also include a skylight cover having an outer frame and a glass pane, wherein the skylight cover may be disposed over the top cover of the flashing surround. Moreover, in this embodiment, the opposing second end of the light tube pitch adapter may be secured to the first end of the cylindrical light tube, the cylindrical base of the collar may be disposed within the first end of the light tube pitch adapter, the upper cylindrical rim of the collar may be disposed on the top cover of the flashing surround, and the cylindrical base of the collar and at least a portion of the light tube pitch adaptor may reside within the exterior base of the flashing surround.

The present invention further includes a method of forming a tubular skylight assembly. The method may include the step of providing a light tube pitch adapter having a first end, an opposing second end, and seams to alter an angle between the first end and the opposing second end. The method may further include the steps of providing a cylindrical light tube having a first end and an opposing second end, providing a collar having an upper cylindrical rim and a cylindrical base, and providing a flashing surround having an exterior base and a top cover, wherein the top cover of the flashing surround may include a circular opening that corresponds in shape and dimension to the first end of the light tube pitch adapter. Additionally, the method may include the step of providing a skylight cover having an outer frame and a glass pane, wherein the skylight cover may be disposed over the top cover of the flashing surround. Furthermore, the method may include the steps of securing the flashing surround to a roof structure so that the exterior base may be disposed on the roof structure, securing the opposing second end of the light tube pitch adapter to the first end of the cylindrical light tube, inserting the cylindrical base of the collar into the first end of the light tube pitch adapter, and inserting the combined collar, light tube pitch adapter, and cylindrical light tube through the circular opening of the flashing surround so that the upper cylindrical rim may be disposed above the top cover of the flashing surround and the cylindrical base of the collar and at least a portion of the light tube pitch adaptor may reside within the exterior base of the flashing surround. The method may also include the step of securing the skylight cover above the collar and top cover of the flashing surround.

The method of installing a tubular skylight assembly may further include the step of adjusting the light tube pitch adapter to a desired angle. Furthermore, the method of installing a tubular skylight assembly may further include the step of securing the cylindrical light tube to a light fixture.

The particular tubular skylight assembly as herein disclosed, illustrated, and described is to be understood as only an embodiment of the present invention and thus representative of the subject matter which is broadly contemplated by the present invention. The scope of the present invention fully encompasses other embodiments that may be or may become obvious to those skilled in the art, and the scope of the present invention is accordingly to be limited by nothing other than the appended claims. In the appended claims, reference to an element in the singular is not intended to mean "one and only one" unless explicitly so stated, but rather "one or more". All structural and functional equivalents to the elements of the above-described embodiment that are known or later come to be known to those of ordinary skill in the art are expressly incorporated herein by reference and are intended to be encompassed by the present claims. Moreover, it is not necessary for a device to address each and every problem sought to be solved by the present invention for it to be encompassed by the present claims. Furthermore, no element, component, or combination in the present disclosure is intended to be dedicated to the public regardless of whether the element, component, or method step is explicitly recited in the claims. No claim element herein is to be construed under the provisions of 35 U.S.C. § 112, sixth paragraph, unless the element is expressly recited using the phrase "means for." Absent express definitions herein, all claim terms are to be given all ordinary and accustomed meanings that are not irreconcilable with the present specification and the file history.

Further, the purpose of the Abstract is to enable the various patent offices and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

What is claimed is:

1. A tubular skylight assembly comprising:

a light tube pitch adapter having a first end, an opposing second end, and seams to alter an angle between the first end and the opposing second end;

a cylindrical light tube having a first end and an opposing second end;

a collar having an upper cylindrical rim and a cylindrical base;

a flashing surround comprising an exterior base and a top cover, wherein the top cover of the flashing surround comprises a circular opening that corresponds in shape and dimension to the first end of the light tube pitch adapter; and a skylight cover comprising an outer frame and a flat glass pane, wherein the skylight cover is disposed over the top cover of the flashing surround;

wherein the opposing second end of the light tube pitch adapter is secured to the first end of the cylindrical light tube, the cylindrical base of the collar is disposed within the first end of the light tube pitch adapter, the upper cylindrical rim of the collar is disposed on the top cover of the flashing surround, and the cylindrical base of the collar and at least a portion of the light tube pitch adaptor reside within the exterior base of the flashing surround.

2. The tubular skylight assembly of claim 1, wherein the flat glass pane is secured within the outer frame of the skylight cover.

3. The tubular skylight assembly of claim 1, wherein the flat glass pane is a single glass pane.

4. The tubular skylight assembly of claim 1, wherein the flat glass pane is double panes of glass.

5. The tubular skylight assembly of claim 4, wherein the double panes of glass comprise a tempered glass pane and an embedded diamond wire glass pane.

6. The tubular skylight assembly of claim 1, wherein the skylight cover forms a rectangular shape.

7. The tubular skylight assembly of claim 1, wherein the exterior base of the flashing surround forms a rectangular shape.

8. The tubular skylight assembly of claim 1, wherein the upper cylindrical rim has an inner diameter and an outer diameter, the cylindrical base has an inner diameter equal to the inner diameter of the rim and an outer diameter less than the outer diameter of the rim.

9. The tubular skylight assembly of claim 1, wherein the cylindrical light tube is rigid.

10. The tubular skylight assembly of claim 1, wherein the cylindrical light tube is flexible.

11. The tubular skylight assembly of claim 1, wherein the cylindrical light tube comprises a flexible light tube and a rigid light tube.

12. The tubular skylight assembly of claim 1, wherein the angle is modifiable by at least 90 degrees.

13. A method for installing a tubular skylight assembly comprising:

providing a light tube pitch adapter having a first end, an opposing second end, and seams to alter an angle between the first end and the opposing second end;

providing a cylindrical light tube having a first end and an opposing second end;

providing a collar having an upper cylindrical rim and a cylindrical base;

providing a flashing surround comprising an exterior base and a top cover, wherein the top cover of the flashing surround comprises a circular opening that corresponds in shape and dimension to the first end of the light tube pitch adapter;

providing a skylight cover comprising an outer frame and a flat glass pane, wherein the skylight cover is disposed over the top cover of the flashing surround;

securing the flashing surround to a roof structure so that the exterior base is disposed on the roof structure;

securing the opposing second end of the light tube pitch adapter to the first end of the cylindrical light tube;

inserting the cylindrical base of the collar into the first end of the light tube pitch adapter;

inserting a combination of the collar, the light tube pitch adapter, and the cylindrical light tube through the circular opening of the flashing surround so that the upper cylindrical rim is disposed above the top cover of the flashing surround and the cylindrical base of the collar and at least a portion of the light tube pitch adaptor reside within the exterior base of the flashing surround; and securing the skylight cover above the collar and top cover of the flashing surround.

14. The method for installing a tubular skylight assembly of claim 13 further comprising adjusting the light tube pitch adapter to a desired angle.

* * * * *